US006736436B1

(12) United States Patent
Tsou

(10) Patent No.: US 6,736,436 B1
(45) Date of Patent: May 18, 2004

(54) REFUSE COLLECTION BAG RETENTION MECHANISM OF REFUSE COLLECTION DEVICE

(76) Inventor: Eric Tsou, 7F, No. 56, Lane 103, Sec. 2, Nei Hu Road, Taipei (TW)

( * ) Notice: Subject to any disclaimer, the term of this patent is extended or adjusted under 35 U.S.C. 154(b) by 0 days.

(21) Appl. No.: 10/428,990

(22) Filed: May 1, 2003

(30) Foreign Application Priority Data

Mar. 11, 2003 (TW) ..... 92203686 U

(51) Int. Cl.[7] ..... A01K 29/00; E01H 1/12
(52) U.S. Cl. ..... 294/1.4; 15/257.6
(58) Field of Search ..... 294/1.3–1.5, 19.1, 294/22, 24, 50.8, 50.9, 55, 115; 15/104.8, 257.4, 257.6, 257.7, 257.1; 119/161, 165

(56) References Cited

U.S. PATENT DOCUMENTS

| | | | | |
|---|---|---|---|---|
| 4,012,067 A | * | 3/1977 | Travis | 294/1.4 |
| 4,149,745 A | * | 4/1979 | Willis | 294/1.4 |
| 5,320,393 A | * | 6/1994 | Cortinas | 294/1.4 |
| 5,540,470 A | * | 7/1996 | Lu | 294/1.4 |
| 5,671,959 A | | 9/1997 | Tsou | 294/1.4 |
| 5,820,179 A | | 10/1998 | Tsou | 294/1.4 |
| 6,019,405 A | | 2/2000 | Tsou | 294/1.4 |

* cited by examiner

*Primary Examiner*—Dean J. Kramer

(57) ABSTRACT

A refuse collection device includes a tubular portion to which a bag mount is attached. The bag mount defines a passage. A cover is movably mounted to the bag mount for openably closing the passage. A flexible bag, such as a plastic bag, has a front opening fit over and releasably secured to the bag mount for receiving refuses through the passage. The bag is comprised of first and second sheets, each having a front edge folded over sections of the bag mount. The front edge of the first sheet forms a cut line dividing the front edge into two opposite free flaps for facilitating mounting the bag to the bag mount. A flap retainer is mounted to the tubular portion and is biased by a torsional spring to securely fix the flaps to the bag mount thereby preventing the flaps from arbitrarily moving within the passage and thus enhancing collection of refuses into the bag. The torsional spring has a small spring constant that is only sufficient to overcome inherent resiliency of the flaps for effectively retaining the flaps in position while causing no substantial interference with mounting and dismounting of the bag to and from the bag mount. An envelop is fit over the cover for protecting the cover from contamination by the collected refuses. A flexible strip extends from the bag, having a free end attached to the envelop whereby the bag and the envelop can be removed from the bag mount at the same time.

11 Claims, 8 Drawing Sheets

REFUSE COLLECTION BAG RETENTION MECHANISM OF REFUSE COLLECTION DEVICE

BACKGROUND OF THE INVENTION

1. Field of the Invention

The present invention relates generally to a refuse collection device for collecting refuse in a flexible container, such as a plastic bag, and in particular to a mechanism for readily and releasably retaining the collection bag on the refuse collection device.

2. The Related Art

Collecting refuses, especially animal droppings, is always a disgusting job. To help people collecting the refuses without using hand to directly pick up the refuses, there are a variety of refuse collection devices proposed and available in the market. One example of the known refuse collection devices is U.S. Pat. No. 6,019,405 issued to the applicant. The known device comprises a flexible container for receiving the collected refuse. The container is attached to the device by means of resiliency of the container itself. However, the known device suffers the disadvantage that opening of the container cannot be securely fixed to the device, leaving a portion of the container unfixed. This leads to poor protection of the device for contamination by the refuse collected in the container.

Thus, it is desired to have an improvement of the refuse collection device to overcome the above-discussed problems.

SUMMARY OF THE INVENTION

An object of the present invention is to provide a refuse collection device comprising a retention mechanism for securely attaching a collection container [[to]] thereto while allowing the container to be readily detached from the device without hand touching the container.

Another object of the present invention is to provide a refuse collection device that is completely protected from contamination caused by the refuse collected therein.

A further object of the present invention is to provide a refuse collection device comprising a retention mechanism for securely fixing opening end of a collection container to the device in order to enhance collection of refuses.

Yet a further object of the present invention is to provide a refuse collection device comprising a retention mechanism which allows for ready mounting of a collection bag to the device while securely fixing the bag to the device without causing undesired contamination of the device.

To achieve the above objects, in accordance with the present invention, there is provided a refuse collection device comprising an upright tubular portion having a lower end to which a bag mount is formed. The bag mount includes a lower section and an upper section spaced from each other to define a refuse passage. A flexible bag, such as a plastic bag, has a front opening fit over the upper and lower sections and is thus attached to the bag mount for receiving refuses through the refuse passage. The bag is comprised of first and second sheets, each having a front edge folded over the upper and lower sections of the bag mount. The front edge of the first sheet forms a cut line dividing the front edge into two opposite free flaps for facilitating mounting the bag to the bag mount. A flap retainer is mounted to the tubular portion and is biased by a torsional spring to securely fix the flaps to the bag mount thereby preventing the flaps from arbitrarily moving within the refuse passage and thus enhancing collection of refuses into the bag. The torsional spring has a small spring constant that is only sufficient to overcome inherent resiliency of the flaps for effectively retaining the flaps in position while causing no substantial interference with mounting and dismounting of the bag to and from the bag mount.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
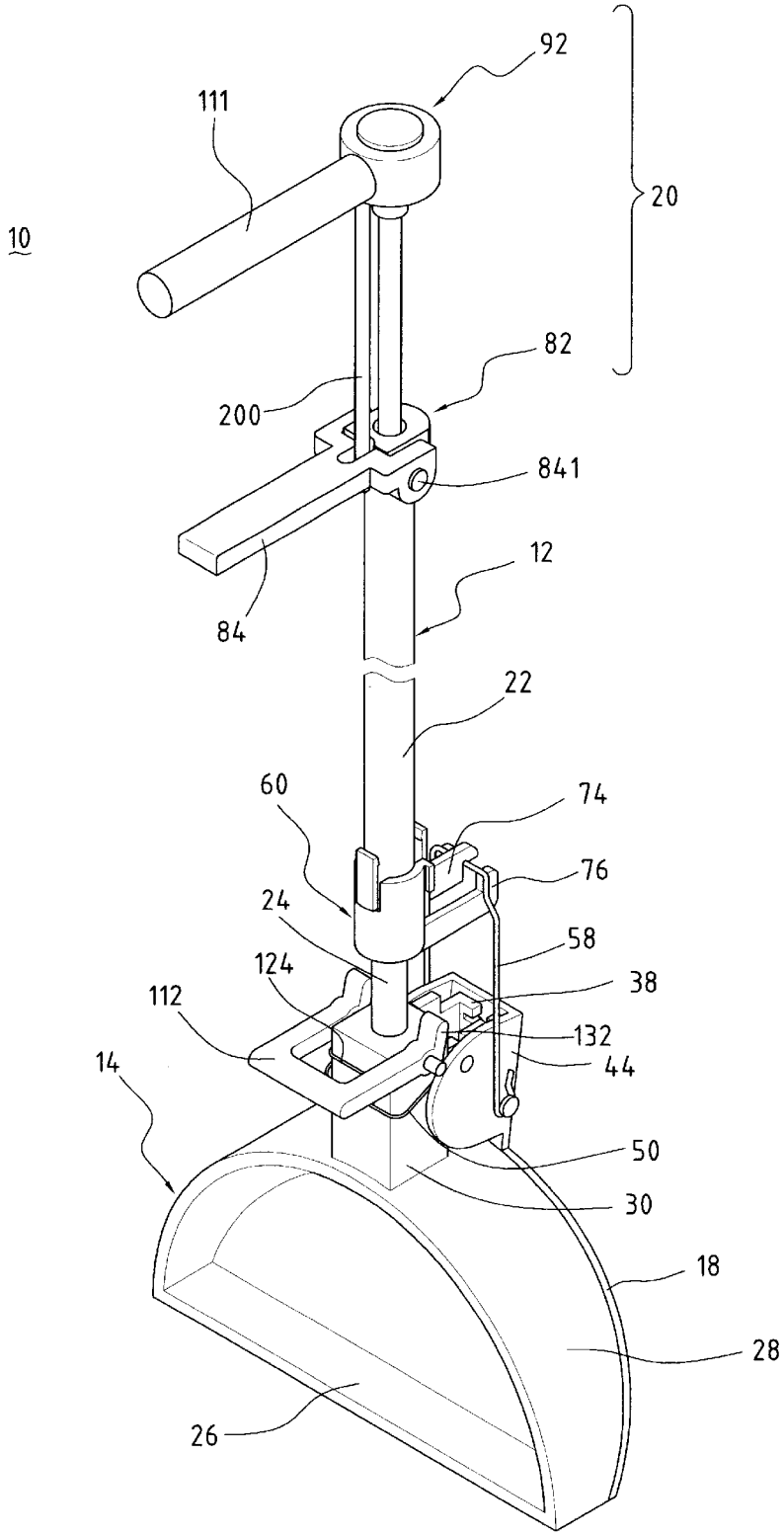
FIG. 1 is a perspective view of a refuse collection device constructed in accordance with the present invention.
Figure 2:
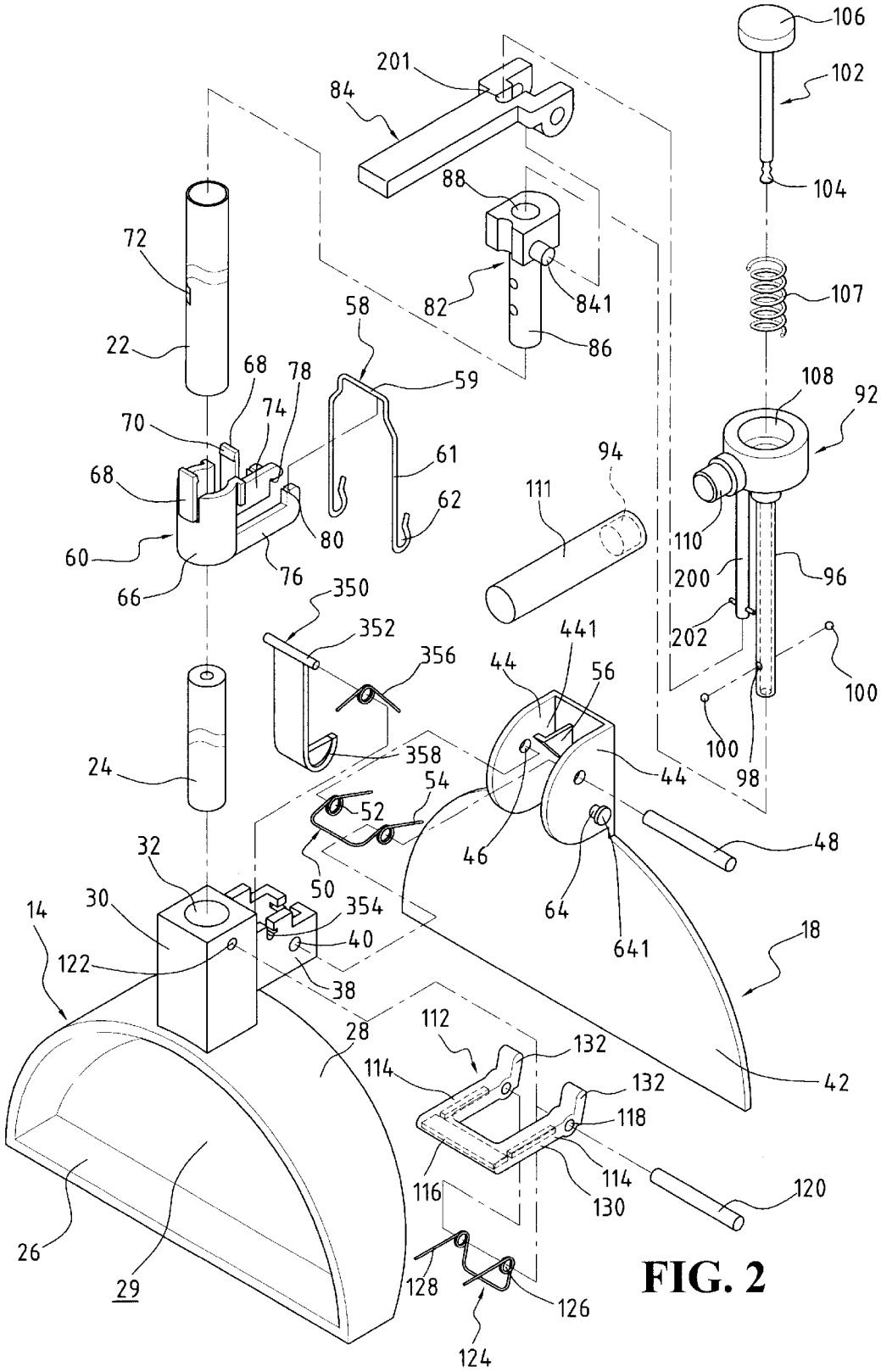
FIG. 2 is an exploded view of the refuse collection device of the present invention.
Figure 3:
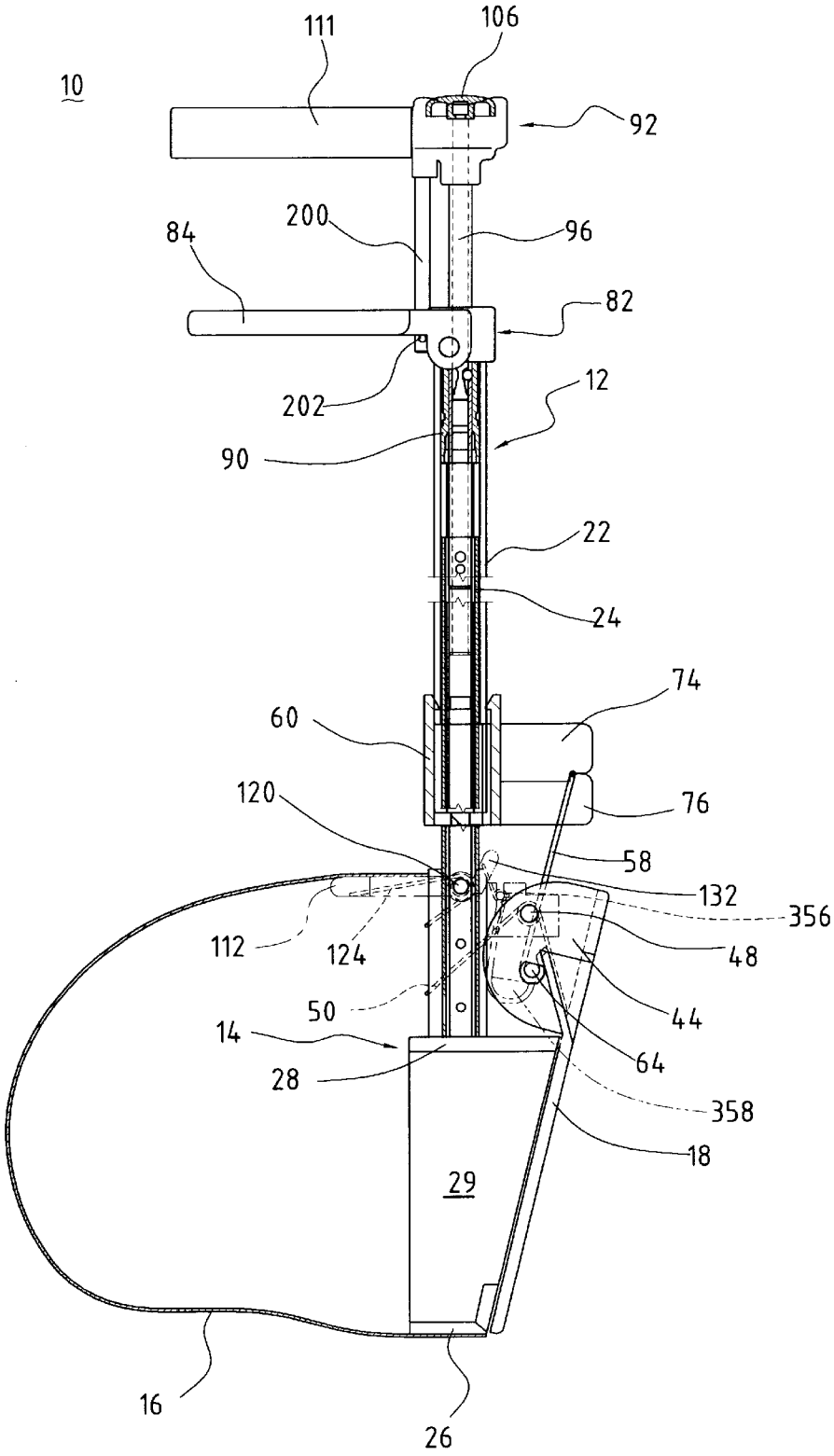
FIG. 3 is a side elevational view, partly sectioned, of the refuse collection device in a closed condition with a refuse collection container attached thereto.

With reference to the drawings and in particular to FIGS. 1–3, a refuse collection device constructed in accordance with the present invention, generally designated with reference numeral 10, comprises an elongated rod or tubular portion 12 which in general use is substantially upright with an axis thereof extending in a vertical direction, having a lower end (not labeled) supporting a bag mount 14 to which a flexible refuse collection container 16, such as a plastic bag (see FIGS. 6–8), is detachably mounted and openably closed by a cover 18 and an upper end (not labeled) to which a control 20 is mounted to selectively open the cover 18 for collecting refuse (not shown) into the refuse collection container 16.

Figure 4:
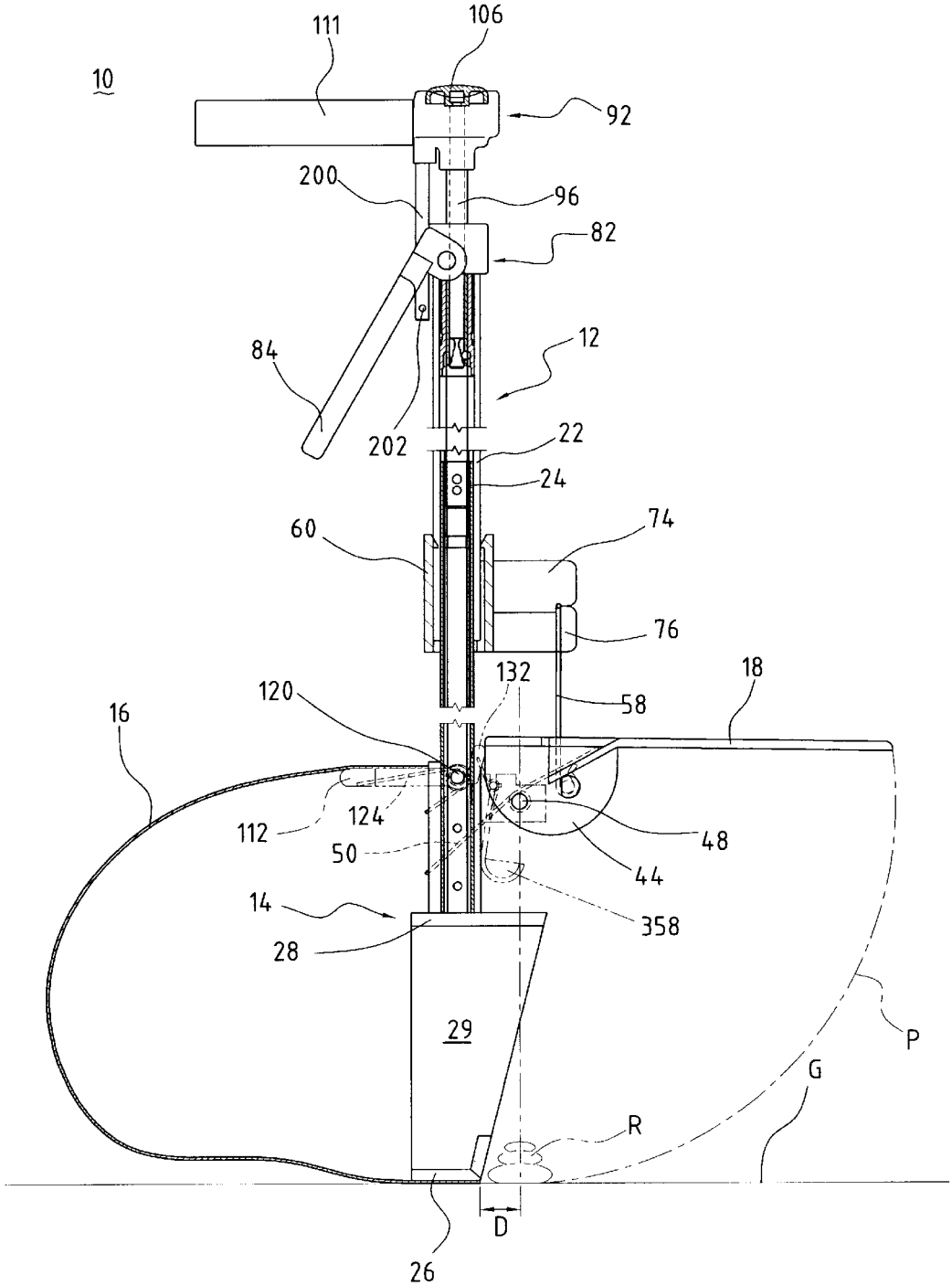
FIG. 4 is similar to FIG. 3 but showing the refuse collection device in an open condition.

The elongated rod portion 12 of the refuse collection device 10 comprises an outer tube 22 and an inner tube 24 telescopically received in the outer tube 22 whereby the outer tube 22 is axially movable with respect to the inner tube 24 between a lower closed position (FIG. 3) and an upper open position (FIG. 4). The outer tube 22 may be further moved to a dumping position (FIG. 5) beyond the upper open position. All these positions will be further discussed. Each of the tubes 22, 24 has an upper end and an opposite lower end. The lower end of the inner tube 24 extends beyond the lower end of the outer tube 22 with the bag mount 14 fixed thereto for supporting the refuse collection container 16.

The bag mount 14 comprises a semi-circular frame (not labeled) having a lower flat section 26 positionable on the ground G as shown in FIG. 4. For example, the bag mount 14 may be positioned in front of a refuse R, such as an animal dropping (shown in phantom lines in FIG. 4 for illustration purposes), and an arc upper section 28 connected to the flat section 26 to define therebetween a refuse passage 29. The bag mount 14 comprises a hollow projection 30 extending from the arc upper section 28 (preferably an upper apex thereof) in a vertically upward direction substantially perpendicular to the lower flat section 26. The projection 30 defines a central bore 32 into which the lower end of the inner tube 24 is inserted. The inner tube 24 is fixed to the projection 30 of the bag mount 14 by any known means, such as welding, bolt-nut pairs or force fitting. A cover support 38 is formed on the projection 30 of the bag mount 14 and extends in a transverse direction. A through hole 40 is defined in the cover support 38.

The cover 18 comprises a semi-circular plate 42, substantially corresponding in shape and size to the semi-circular frame of the bag mount 14. The semi-circular plate 42 comprises two lugs 44 extending therefrom and spaced from each other. The lugs 44 define aligned holes 46 corresponding to the through hole 40 of the cover support 38 of the projection 30 of the bag mount 14 for the extension of a pivot pin 48 therethrough. This allows the cover 18 to rotate about the pivot pin 48 with respect to the bag mount 14 (as well as the projection 30) and thus making the semi-circular plate 42 of the cover 18 movable relative to the bag mount 14 between a closed position (FIG. 3) and an open position (FIG. 4) for closing/opening the refuse passage 29 defined between the upper section 28 and the lower section 26 of the bag mount 14.

A biasing element 50 is provided between the cover support 38 and the cover 18 to bias the cover 18 toward the closed position for normally closing the refuse passage 29 of the bag mount 14. The refuse passage 29 of the bag mount 14 is normally closed by the cover 18 under the biasing force of the biasing element 50 and can only be opened by manually moving the cover 18 against the biasing element 50 which will be further discussed. This prevents the refuse collected in the refuse collection container 16 that is mounted to the bag mount 14 from accidentally getting out of the refuse collection container 16 and causing a second time contamination.

In the embodiment illustrated, the biasing element 50 comprises a torsional spring, having a U-shaped configuration comprising two limbs connected by a bottom (both not labeled for simplifying the drawings). Each limb of the U-shaped configuration forms a coil 52 and has a free end 54. The pivot pin 48 of the cover 18 extends through the coils 52 for supporting and retaining the biasing element 50 in position. The bottom of the U-shaped configuration is attached to and supported by the projection 30 of the bag mount 14 and each free end 54 of the U-shaped configuration is fixed to the cover 18 by inserting into a slot 441 defined between each lug 44 and support plate 56 adjacent to and opposite to the lug 44 whereby the spring exerts the biasing force between the cover 18 and the cover support 38 of the bag mount 14.

A connection link 58, substantially U-shaped, has a bottom section 59 attached to the outer tube 22 by a retainer 60 and two side sections 61 each having a free end forming a hook 62 engaging a sideway-projecting pin 64 extending from each lug 44 of the cover 18 and having an expanded end 641. The connection link 58 allows the user to open the cover 18 by axially moving the outer tube 22 with respect to the inner tube 24 in an upward direction from the closed position to the open position. By moving the outer tube 22, the retainer 60 that is fixed to the outer tube 22, drives the cover 18, via the connection link 58, to rotate about the pivot pin 48 from the closed position to the open position for exposing the refuse passage 29 of the bag mount 14.

The retainer 60, which can be made of molded plastics, comprises a cylindrical body 66 snugly fit over the lower end of the outer tube 22. Two resilient fingers 68 are formed on opposite sides of the cylindrical body 66, each having a free end forming a barb 70 engaging a corresponding slot 72 defined in the outer tube 22 thereby attaching the retainer 60 to the outer tube 22. Upper and lower retaining boards 74, 76 extend transversely from the cylindrical body 66. Notches 78, 80 are defined in the upper and lower retaining boards 74, 76. In the embodiment illustrated, two lower boards 76 are provided and are spaced from each other with a single upper board 74 located above the lower boards 76 and at a position substantially midway between the lower boards 76. The notches 78, 80 of the upper and lower boards 74, 76 have arc configuration and are complementary to each other whereby the notches 78, 80 together, when viewed sideways, form a circular channel in which the bottom section 59 of the connection link 58 is accommodated. Thus, the bottom section 59 of the connection link 58 is seated in the notches 78, 80 whereby the bottom section 59 of the connection link 58 is gripped by and pinched between the upper and lower boards 74, 76. It is apparent to those having ordinary skills to replace the upper and lower boards 74, 76 with other structure to retain the bottom section 59 of the connection link 58.

The control 20 comprises a movable handle 82 mounted to the upper end of the outer tube 22 and a fixed handle 92 mounted to the upper end of the inner tube 24. The movable handle 82 comprises a handle bar 84 pivotally mounted to the movable handle 82 by a pivot 841 whereby the handle bar 84 is movable with respect to the movable handle 82 between a released condition and an erected condition where the handle bar 84 extends transversely from the movable handle 82. The movable handle 82 further comprises a cylindrical sleeve 86 mounted to the upper end of the outer tube 22 whereby the movable handle 82 is movable in unison with the outer tube 22. If desired, the sleeve 86 can be separated from the movable handle 82 and integrally formed with the outer tube 22. A central bore 88 is defined in the cylindrical sleeve 86. A multi-stepped groove 90 (FIG. 3) is defined in an inside surface (not labeled) of the bore 88 of the sleeve 86. The structure of the multi-stepped groove 90 is disclosed in detail in the above mentioned U.S. Pat. No. 6,019,405 and thus no further description will be given herein.

The fixed handle 92 comprises a handle bar 111 corresponding in spatial position to the handle bar 84 of the movable handle 82. Preferably, the handle bar 111 of the fixed handle 92 is detachably mounted to the fixed handle 92. For example and as illustrated in the drawings, a threaded extension 110 transversely extends from the fixed handle 92 and threadingly and thus detachably engages an inner threading 94 of the handle bar 111 to mount the handle bar 111 to the fixed handle 92 for allowing the user to hold the refuse collection device 10 in a direction facing a refuse R to be collected for best operation of the refuse collection device 10. A hollow shaft 96 extends from the handle 92 and is axially and movably received in the central bore 88 of the sleeve 86. The hollow shaft 96 has a lower end (not labeled) securely fixed to the upper end of the inner tube 24. (Alternatively, the hollow shaft 96 can be made an integral part of the inner tube 24.) The hollow shaft 96 is provided with a plurality of radially extending openings 98 around a circumference thereof to each movably receive a spherical member 100 whereby the spherical members 100 are allowed to partly move in and out of the multi-stepped groove 90 of the sleeve 86. The openings 98 are sized to allow the spherical members 100 to freely move therethrough. In the embodiment illustrated, there are two openings 98 formed on the shaft 96 and arranged to be diametrically opposite to each other.

The control 20 further comprises a shank 102 axially and movably received in the hollow shaft 96. The shank 102 forms a multi-stepped groove 104 formed on a lower end thereof and corresponding in position to the openings 98 of the hollow shaft 96. The structure and operation of the multi-stepped groove 104, as well as the spherical members 100 and the multi-stepped groove 90 of the sleeve 86, are disclosed and taught in the above-mentioned U.S. Pat. No. 6,019,405 and thus no further discussion is needed herein.

The shank 102 has an expanded upper end forming a pushbutton 106. The fixed handle 92 forms a recess 108 in an upper surface (not labeled) thereof for movably receiving the pushbutton 106 therein. Biasing means, such as helical spring 107, is disposed between the pushbutton 106 and the recess 108 for biasing the pushbutton 106 to a non-actuated position, which will be further discussed.

A driving link 200 extends downward from the fixed handle 92 and extends through a slot 201 defined in the movable handle bar 84 of the movable handle 82. Sideways projections 202 extend from a lower free end (not labeled) of the driving link 200 in opposite directions whereby when the outer tube 22 is moved to the lower position (FIG. 3), the projections 202 engage opposite sides of the slot 201 of the movable handle bar 84 and maintain the movable handle bar 84 at the erected condition to allow hand holding by the user for moving the outer tube 22 from the lower position toward the upper position and even the dumping position. When the outer tube 22 is moved to the upper position as shown in FIG. 4, the movable handle bar 84 is no longer supported by the projections 202 and is thus allowed to move to the released condition, clearing the space below the handle bar 111 of the fixed handle 92 for convenience of operation.

Figure 5:
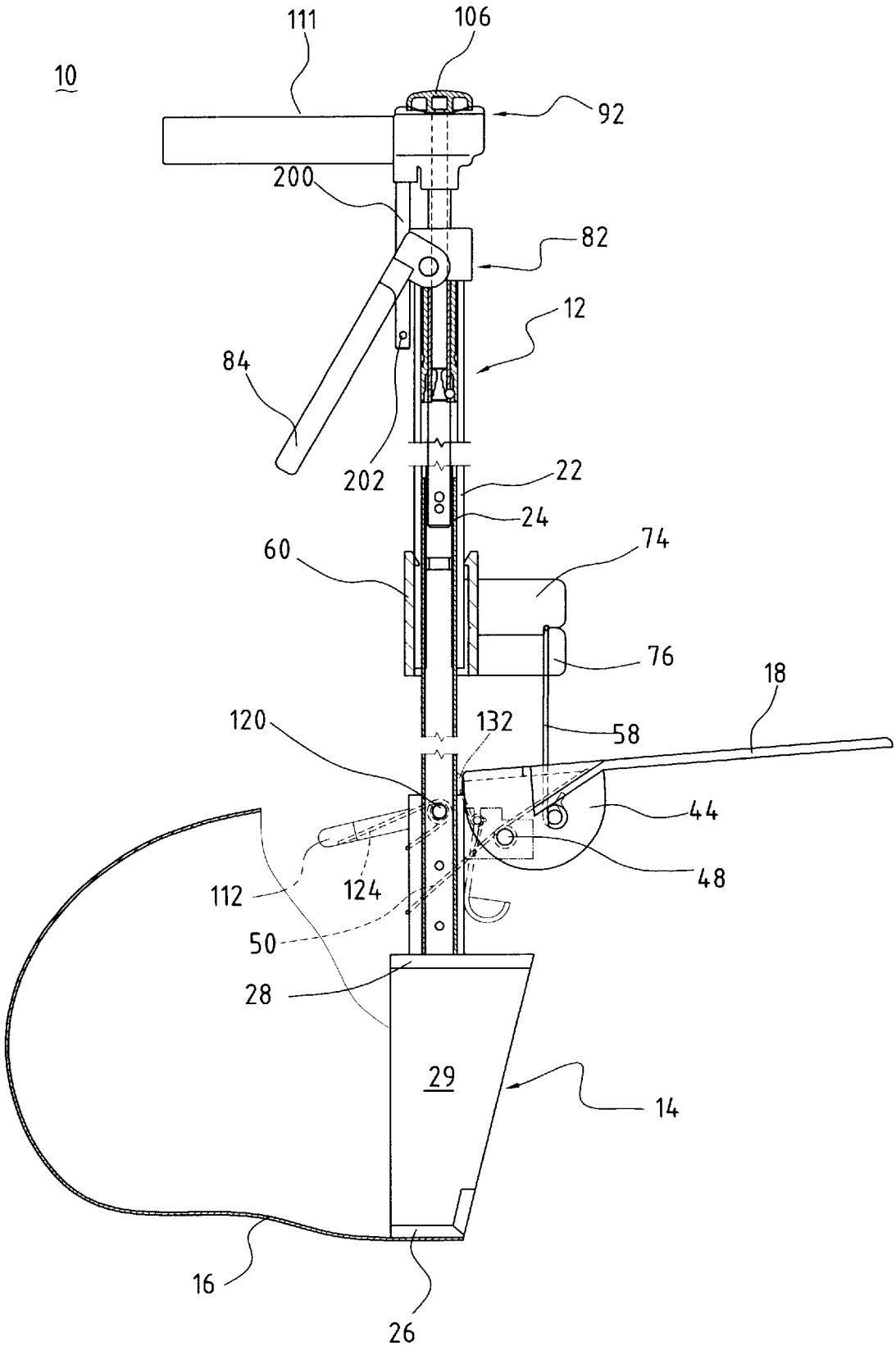
FIG. 5 is similar to FIGS. 3 and 4 but showing the refuse collection device in a dumping condition.

A bag release 112 is rotatably mounted to the projection 30 of the bag mount 14 substantially opposite to the cover 18. The bag release 112 has a U-shaped configuration having two spaced side sections 114 and a connection section 116 connected between the side sections 114. The side sections 114 are located on opposite sides of the projection 30 and define aligned holes 118 for receiving a pivot pin 120 which is mounted to the projection 30, such as extending through holes 122 defined in the projection 30, whereby the bag release 112 is movable with respect to the bag mount 14 between a bag-holding position (corresponding to the closed and open positions of the outer tube 22 and the cover 18 as shown in FIGS. 3 and 4) and a bag-releasing position (corresponding to the dumping position of the outer tube 22 and the cover 18 as shown in FIG. 5). In the bag-holding position, the connection section 116 of the bag release 112 is substantially horizontal, or even slightly upward inclined, for engaging and supporting an edge of the refuse collection container 16. The refuse collection container 16 is thus tightly fixed between the bag release 112 and the bag mount 14 (especially the flat section 26 of the bag mount 14). When the bag release 112 is moved to the bag-releasing position (in response to the movement of the outer tube 22 and the cover 18 toward the dumping position), the connection section 116 is slightly inclined downward, allowing the bag 16 to slip off of the bag release 112 and thus automatically removing the refuse collection container 16 from the refuse collection device 10.

A biasing element 124 is arranged between the bag release 112 and the bag mount 14 to bias the bag release 112 to the bag-holding position. The biasing element 124 comprises a U-shaped spring having two limbs each forming a coil 126 through which the pivot pin 120 extends for supporting and retaining the biasing element 124 in position. The limbs of the biasing element 124 has free end 128 received and retained in slots 130 defined in the side sections 114 of the bag release 112 for supporting and biasing the bag release 112 to the bag-holding position.

The side sections 114 of the bag release 112 have proximal ends 132. The ends 132 of the bag release 112 are located and dimensioned to be engageable by the lugs 44 of the cover 18 whereby when the cover 18 is moved from the open position to the dumping position, the lugs 44 thereof engage the ends 132 of the bag release 112 and initiate rotation of the bag release 112 with respect to the projection 30 of the bag mount 14, thereby tilting the bag release 112 to release the refuse collection container 16 from the bag mount 14.

Also referring to FIG. 4, to collect refuses, with the cover 18 opened, one may position the refuse collection device 10 next to the refuse R with the refuse passage 29 of the bag mount 14 facing the refuse R. To open the cover 18, one may move the movable handle 82 toward the fixed handle 92 whereby the cover 18 is driven by the outer tube 22 via the connection link 58 to the open position (FIG. 4). The outer tube 22 and thus the cover 18 are maintained in the open condition by the spherical members 100 engaging the multi-stepped grooves 90, 104 of the sleeve 86 and the shank 102. This is described in detail in the above-mentioned U.S. Pat. No. 6,019,405 and constitutes no novel part of the application. Thus, no detail regarding the operation of the spherical members 100, as well as the multi-stepped grooves 90, 104, is given herein.

Thereafter, by depressing the pushbutton 106 against the spring 107 from the non-actuated position to an actuated position, the shank 102 is forced downward and the engagement between the spherical members 100 and the multi-stepped grooves 90, 104 of the sleeve 86 and the shank 102 that maintains the cover 18 in the open position is broken. The cover 18 is driven back to the closed position by the biasing force of the biasing element 50. With the refuse R to be collected located in the path of the movement of the cover 18 when the cover 18 moves from the open position to the closed position, the cover 18 hits and scoops the refuse into the refuse collection container 16.

To dispose the collected refuse, the refuse collection container 16 is detached from the bag mount 14 without the user's hand(s) directly touching the refuse collection container 16. This is done by manually moving the movable handle 82 toward the fixed handle 92 with the cover 18 moving from the closed position and passing the open position and toward the dumping position as shown in FIG. 5. The bag release 112 that supports the refuse collection container 16 on the bag mount 14 is tilted thereby releasing the refuse collection container 16 from the bag mount 14.

The bag release 112 and the cover 18 are maintained in the dumping position by the spherical members 100 as described in the above mentioned U.S. Pat. No. 6,019,405. To release the cover 18 from the dumping position shown in FIG. 5, one may simply depress the pushbutton 106 to move the shank 102 downward so as to break the engagement between the spherical members 100 and the grooves 90, 104 that maintains the cover 18 in the dumping position. The cover 18 is now allowed to move downward along the arc path P (FIG. 4) and thus closing the cover 18.

Referring back to FIGS. 3–5, the bag mount 14 has an inclined side profile whereby the flat section 26 of the bag mount 14 is spaced from a position corresponding to the pivot pin 48 of the cover 18 in the vertical direction and a distance D therebetween is sufficient to provide a space for accommodating the refuse R to be collected at a position substantially corresponding to the pivot pin 48 of the cover 18 in the vertical direction. This allows the refuse R to be positioned at the lowermost point of the path P of the cover 18 whereby the cover 18 hits the refuse R with the greatest speed that the cover 18 in a most complete way.

In addition, since the refuse R is located at the lowermost point of the path P of the cover 18, the cover 18 can hit almost all of the refuse R to completely move the refuse R into the container 16.

Figure 6:
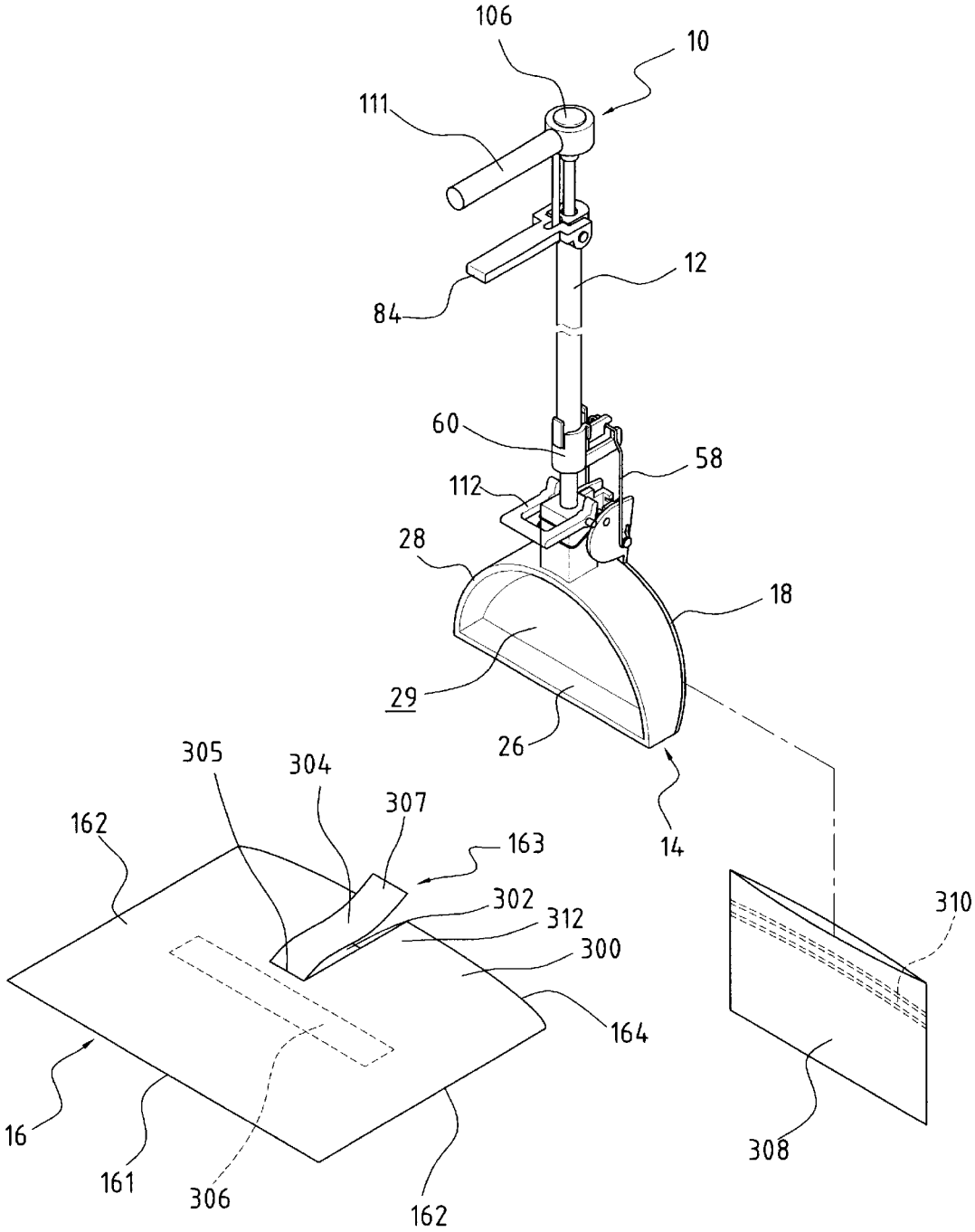
FIG. 6 is a perspective view of the refuse collection device in accordance with the present invention and a refuse collection container and a cover envelop that are shown detached from the refuse collection device.
Figure 7:
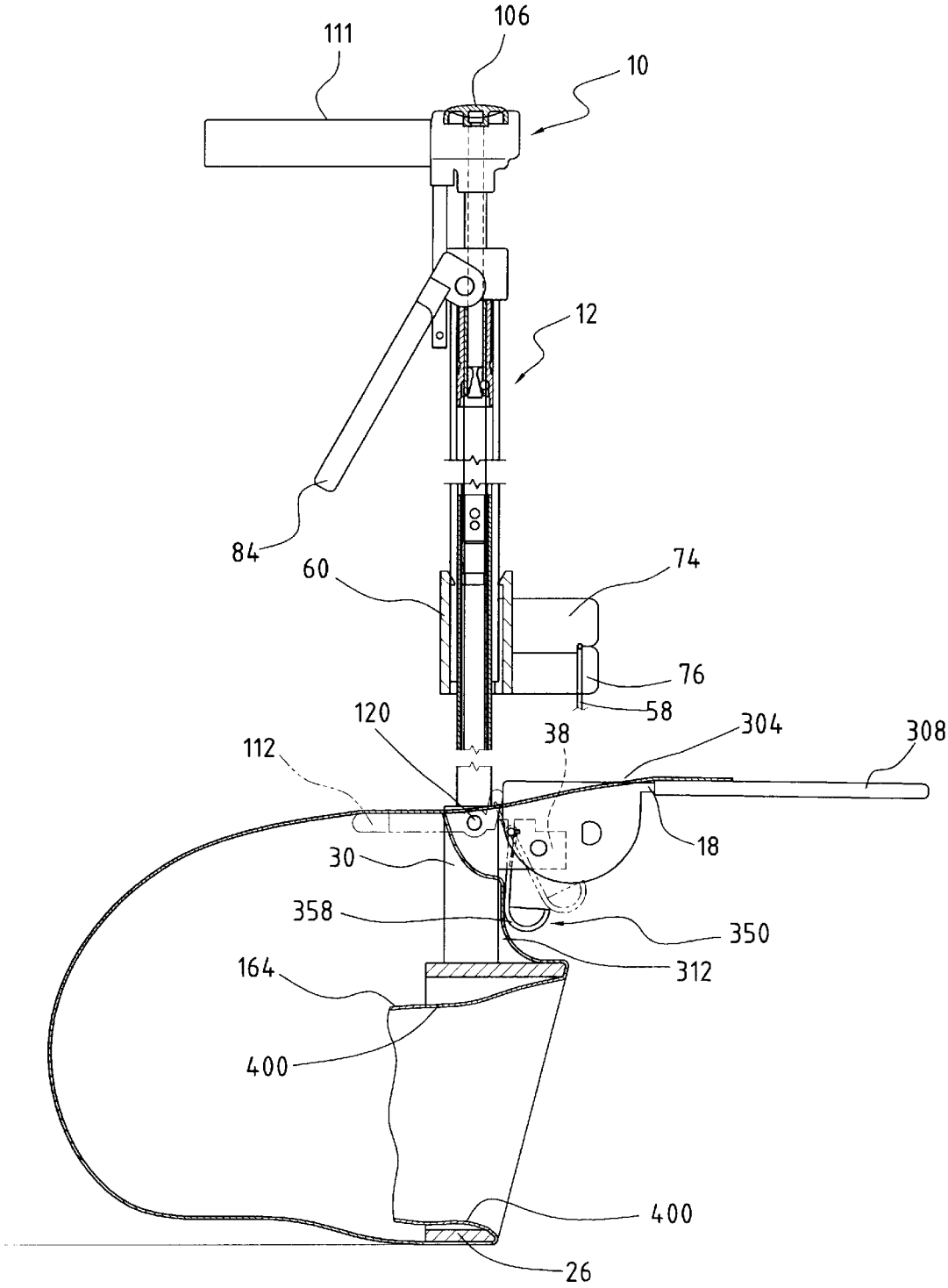
FIG. 7 is a side elevational view, partially sectioned, of the refuse collection device of the present invention with the refuse collection container and the cover envelop attached thereto.
Figure 8:
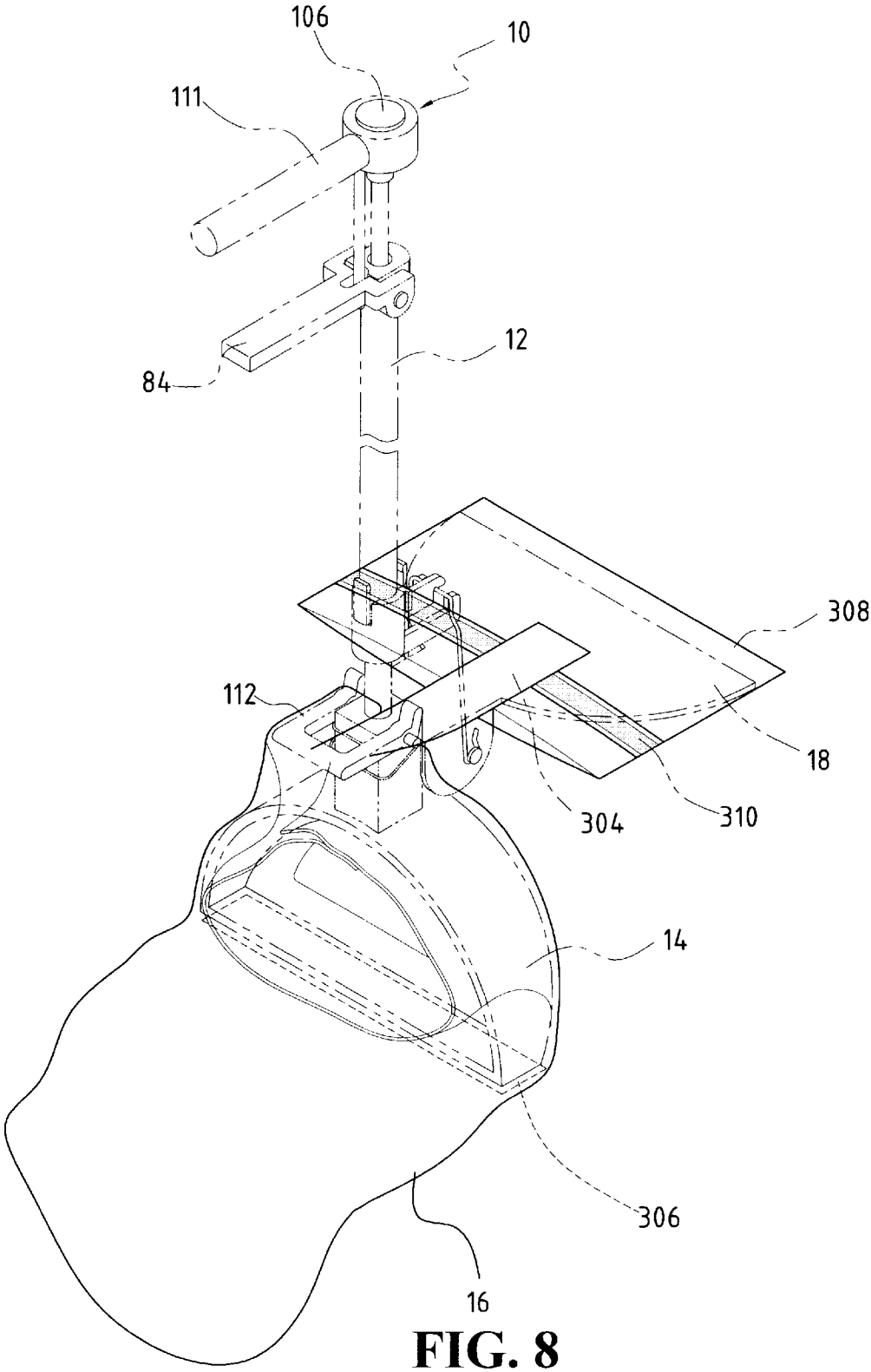
FIG. 8 is a perspective view of the refuse collection device with the refuse collection container and the cover envelop attached thereto.

Referring to FIGS. 6–8, in the embodiment illustrated, the refuse collection container 16 is made of plastics as a plastic bag, comprising two opposite and spaced plastic sheets 300, 302 sealed together along a rear edge 161 and two lateral edges 162 to define a front opening 163 for fitting over the bag mount 14. It is apparent that the refuse collection container 16 can be made of other materials, such as paper sheet with wax coating. Two cut lines (not labeled) are formed in the first plastic sheet 300 and extend from the front edge 164 of the first plastic sheet 300 to a desired length whereby a strip 304 is formed with one end 305 attached to the first plastic sheet 300 and the first plastic sheet 300 forms two flap portions 312 on opposite sides of the strip 304. The strip 304 has a free end 307 extending beyond the front edge 164 of the first plastic sheet 300. A reference mark 306 is printed on the second plastic sheet 302.

To mount the plastic bag 16 to the bag mount 14, the bag 16 is widely opened with the lower flat section 26 of the bag mount 14 positioned on an inner surface of the second plastic sheet 302 substantially corresponding to the reference mark 306. The first plastic sheet 300 is slightly stretched and fit over the bag release 112. This retains the bag 16 on the bag mount 14 due to the restoring force caused by the stretching of the bag 16. The strip 304 may now extend over the arc upper section 28 of the bag mount 14 with the free end 307 thereof engaging a cover envelop 308, preferably made of plastics in the form of a plastic bag, fit over the cover 18. In the embodiment illustrated, the cover envelop 308 is coated with an adhesive material 310 to which the free end 307 of the strip 304 attaches. This secures both the bag 16 and the cover envelop 308 in position. The cover envelop 308 helps preventing the cover 18 from being contaminated by the collected refuse. Front portions 400 (FIG. 7) of the first and second plastic sheets 300, 302 of the bag 16 are folded inward and over the upper and lower sections 28, 26 of the bag mount 14 to substantially shield and prevent the upper and lower sections 28, 26 of the bag mount 14 from being contaminated by the collected refuse.

To prevent undesired unfolding of the front portions 400 of the first and second plastic sheets 300, 302 caused by the inherent resiliency of the plastic material, in accordance with the present invention, a flap retainer 350 is movably attached to the projection 30 of the bag mount 14. Also referring to FIG. 2, the flap retainer 350 comprises a pivot 352 rotatably received in holes 354 defined in the cover support 38 that is fixed to the projection 30. The flap retainer 350 is biased by a torsional spring 356 to urge a rounded lower end 358 thereof against the projection 30 by rotating about the pivot 352. Preferably, the pivot 352 is located at an upper end of the flap retainer 350 and is opposite to the rounded lower end 358. Due to the folding of the first plastic sheet 300 over the upper section 28 of the bag mount 14 and due to the arcuate configuration of the upper section 28, the flap portions 312 partially overlap each other on the folded portions thereof. The overlapped portions of the flap portions 312 of the first plastic sheet 300 are positioned between the rounded end 358 of the flap retainer 350 and the projection 30 by manually moving the rounded end 358 against the torsional spring 356 (as shown in phantom lines in FIG. 7). The flap portions 312 are thus secured by the flap retainer 350 and this prevents the folded front portions 400 of the bag 16 from undesirably unfolding. To allow for easy operation and due to the fact that the inherent resiliency of the plastic sheets 300, 302 is small, the spring constant of the spring 356 is selected to be small and just sufficient to overcome the inherent resiliency of the plastic sheets 300, 302. The small spring constant of the spring 356 also helpful in removing the plastic bag 16 from the bag mount 14 and this will be further discussed.

To remove the plastic bag 16 from the refuse collection device 10, the movable handle 82 is moved to the dumping position, which tilts the bag release 112 and thus loosening the plastic bag 16. The tubular portion 12 is then held in a substantially horizontal condition with the plastic bag 16 located on the lower side of the bag mount 14 and the cover 18 on the upper side of the bag mount 14. The plastic bag 16 is thus allowed to detach from the bag mount 14 by means of the gravity of the refuse collected in the plastic bag 16. At this moment, due to the adhesion connection between the free end 307 of the plastic bag 16 and the cover envelop 308 and further due to the engagement between the cover envelop 308 and the cover 18, the plastic bag 16 hangs below the tubular portion 12 but is not completely separated from the refuse collection device 10. As mentioned above, the spring constant of the spring 356 is small whereby the weight of the collected refuse can easily overcome the spring force of the flap retainer 350 to detach the plastic bag 16 from the bag mount. In other words, the spring force of the spring 356 does not interfere with detaching the plastic bag 16 from the bag mount 14.

By rotating the refuse collection device 10 about the tubular portion 12 an angle around 180 degrees, the plastic bag 16 is now moved to the same side of the cover 18 with respect to the bag mount 14 and the gravity of the refuse collected in the bag 16 forces the cover envelop 308 to detach from the cover 18, making the plastic bag 16 and the cover envelop 308 completely separated from the refuse collection device 10. Thus, the refuse collected and the plastic bag 16 can be disposed of by simply dropping into a garbage can without any hand contacting the plastic bag 16 and the envelop 308. Meanwhile, the refuse collection device 10 is completely free of contamination caused by the collected refuse for being protected by the plastic bag 16 and the envelop 308.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A device for collecting a refuse comprising:

an upright rod assembly;

a bag mount attached to a lower end of the rod assembly, the bag mount comprising upper and lower sections defining a passage therebetween, a projection extending from the upper section;

a resiliently biased flap retainer movably attached to the projection, the flap retainer comprising a pivot rotataby fixing the flap retainer to the projection and a resilient member biasing the flap retainer; and a flexible container defining a front opening fit over the bag mount and slightly stretched between the upper and lower sections of the bag mount, the flexible container having front portions folded over and substantially shielding the bag mount;

wherein a portion of the flap retainer is urged against the projection by rotating about the pivot thereby interposing a portion of the flexible container between the projection and the flap retainer, and the resilient member comprises a torsional spring having a spring constant only sufficient to overcome inherent resiliency of the flexible container and causing no substantial interference with mounting and dismounting of the flexible container to and from the bag mount.

2. The device as claimed in claim 1 further comprising a cover pivotally mounted to the bag mount by a pivot and rotatable with respect to the bag mount, a cover envelop fit over the cover.

3. The device as claimed in claim 2, wherein the flexible container comprises a strip having a free end, the cover envelop having an adhesive coating to which the free end of the strip of the flexible container is attached to retain the flexible container and the cover envelop in position.

4. The device as claimed in claim 3, wherein the flexible container comprises first and second plastic sheets having rear edges and opposite lateral edges sealed to form a bag having the front opening, two cut lines being formed in the first plastic sheet to form the strip having a free end extending beyond a front edge of the first plastic sheet, the first plastic sheet forming two flap portions on opposite sides of the strip, the flap portions overlapping each other and positioned between the flap retainer and the projection to be secured in position.

5. The device as claimed in claim 4, wherein the second plastic sheet comprises a reference mark printed thereon on which the lower section of the bag mount is positioned in mounting the flexible container to the bag mount.

6. The device as claimed in claim 1, wherein the flexible container comprises first and second plastic sheets having rear edges and opposite lateral edges scaled to form a bag having the front opening, at least one cut line being formed in the first plastic sheet to form flap portions that overlap each other and are positioned between the flap retainer and the projection to be secured in position.

7. The device as claimed in claim 6, wherein the second plastic sheet comprises a reference mark printed thereon on which the lower section of the bag mount is positioned in mounting the flexible container to the bag mount.

8. The device as claimed in claim 1, wherein the portion of the flap retainer that interposes the flexible container between the flap retainer and the projection has a rounded configuration.

9. A flexible collection container used in a device for collecting a refuse, the device comprising an upright rod assembly and a bag mount attached to a lower end of the rod assembly and comprising upper and lower sections defying a passage therebetween, the flexible collection container comprising:

first and second opposite flexible sheets having rear edges and opposite lateral edges sealed together to form a bag having a front opening, two cut lines being formed in the first sheet to form a strip having a free end extending beyond a front edge of the first sheet, the first sheet forming two flap portions on opposite sides of the strip, the flap portions overlapping each other and adapted to be secured between a resiliently biased flap retainer and a portion of the bag mount, the free end of the strip releasably attached to a portion of the device to help retain the flexible collection container in position;

wherein the second sheet comprises a reference mark printed thereon for properly positioning the flexible collection container with respect to the bag mount.

10. The flexible collection container as claimed in claim 9, wherein the first and second sheets are made of plastics.

11. A device for collecting a refuse, comprising:

an upright rod assembly;

a bag mount attached to a lower end of the rod assembly, the bag mount comprising upper and lower sections defining a passage therebetween, a projection extending from the upper section;

a resiliently biased flap retainer movably attached to the projection; and a flexible container comprising first and second plastic sheets having rear edges and opposite lateral edges scaled to form a bag and define a front opening fit over the bag mount, the flexible container having front portions folded over and substantially shielding the bag mount;

wherein the first plastic sheet comprises at least one cut line to form flap portions that overlap each other and arc positioned between the flap retainer and the projection to be secured in position, and the second plastic sheet comprises a reference mark printed thereon on which the lower section of the bag mount is positioned in mounting the flexible container to the bag mount.

* * * * *